US006237199B1

(12) United States Patent
Chou Wang

(10) Patent No.: US 6,237,199 B1
(45) Date of Patent: May 29, 2001

(54) ZIPPER SLIDE WITH MEANS FOR RESTRAINING PULL TAB THEREOF FROM SWINGING

(76) Inventor: Wallace Lien Chou Wang, No. 30, Lane 252, Sun-Jin St., Su-Lin Jen, Taipei Hsien (TW)

( * ) Notice: Subject to any disclaimer, the term of this patent is extended or adjusted under 35 U.S.C. 154(b) by 0 days.

(21) Appl. No.: 09/450,706

(22) Filed: Nov. 26, 1999

(51) Int. Cl.[7] ..... A44B 19/26; A44B 19/30
(52) U.S. Cl. ..... 24/429; 24/421
(58) Field of Search ..... 24/429, 430, 418–425

(56) References Cited

U.S. PATENT DOCUMENTS 2,262,188 * 11/1941 Marinsky .
2,383,197 * 8/1945 Johnson .
3,899,804 * 8/1975 Kawashima .
3,955,248 * 5/1976 Akashi .
4,389,758 * 6/1983 Akashi .

* cited by examiner

*Primary Examiner*—James R. Brittain
(74) *Attorney, Agent, or Firm*—W. Wayne Liauh

(57) ABSTRACT

A zipper slide with means for restraining a pull tab thereof from swinging is provided. The zipper slide is composed of a slide and a pull tab. The pull tab includes a tab portion and a U-shaped buckle connected to a rear end of the tab portion. The slide is formed of a central passage for the U-shaped buckle to extend therethrough and be fixed thereto. An elastic projection axially extends from the rear end of the tab portion, and the slide is formed at a top front with a hollow space into which the elastic projection extends when the tab portion is in a flat position relative to the slide. When the tab portion is pivotally turned upward relative to the slide, the elastic projection is brought into contact with a front edge of the hollow space, and a further pull would deform the elastic projection to bring the same to move out of the hollow space for moving the slide forward or backward. And when the tab portion is pushed downward relative to the slide from a movable position, the elastic projection is deformed relative to the top plate to slip into the hollow space again to restrain the pull tab from swinging relative to the slide.

2 Claims, 6 Drawing Sheets

ZIPPER SLIDE WITH MEANS FOR RESTRAINING PULL TAB THEREOF FROM SWINGING

BACKGROUND OF THE INVENTION

The present invention relates to a zipper slide, and more particularly to a zipper slide provided with means for restraining a pull tab thereof from swinging when the slide has been moved with the pull tab to a desired position on a zipper.

There are times some clothes or articles, such as zipper sports jackets and pants, need to have a pull tab of the zipper thereof selectively fixed in place to prevent the tab from swinging while the wearer is moving.

FIGS. 1 and 2 illustrate a currently commercially available zipper slide, a pull tab of which can be fixed in place to prevent the same from swinging. Such conventional zipper slide mainly includes a slide 10 provided with a leaf spring 11 and a tab 12 having a buckle 13 connected thereto. A cam 14 is connected to a head of the buckle 13 and is normally pressed by the leaf spring 11, such that when the tab 12 is pivotally turned downward by a certain angle relative to the slide 10, the leaf spring 11 automatically presses the tab 12 to a flat position, as shown in FIG. 2, and therefore restrains the tab 12 from swinging. Following are some disadvantages of the above-described conventional zipper slide with tab-restraining means:

1. High Manufacturing Cost is Required:

The leaf spring 11 would be stuck to the slide 10 and loses its designed elasticity if it is plated after being assembled to the slide 10. To keep the leaf spring 11 in a suitable elastic state, it and the slide 10 must be separately plated before being connected to each other. This inevitably increases the manufacturing cost of the zipper slide.

2. Baking Finish is not Applicable:

Baking finish conducted on assembled slide 10 and leaf spring 11 would cause the leaf spring 11 to stick to the slide 10 and lose its designed elasticity, too. And, paint on the slide 10 might be scraped off by the leaf spring 11 when assembling the latter to the slide 10, if the slide 10 and the leaf spring 11 are separately baking-finished.

3. Automated Connection of Slide to Zipper Tapes is not Possible:

The tab 12 automatically moves downward to lie flatly when the tab 12 is set to a certain angular position relative to the slide 10 as shown in FIG. 3. This prevents the tab 12 from being well clamped by tools in the automated operation of connecting the slide 10 to zipper tapes.

The above-described conventional zipper slide with tab-restraining means requires high manufacturing cost and is therefore suited for use only on expensive clothes or articles. For less expensive clothes and articles, a zipper slide 20 without tab-restraining means as that shown in FIG. 4 is used. The sipper slide 20 can be manufactured at low cost, but its tab 21 could not be fixed in place and would swing with movements of a wearer.

SUMMARY OF THE INVENTION

It is therefore a primary object of the present invention to provide a zipper slide with means for restraining a pull tab thereof from swinging. The sipper slide of the present invention has simple structure and can be manufactured at low cost to allow economical and practical use thereof.

The zipper slide of the present invention mainly includes a slide and a pull tab. The pull tab includes a tab portion and a U-shaped buckle connected to a rear end of the tab portion.

The slide is formed of a central passage for the U-shaped buckle to extend therethrough and be fixed thereto. Means provided on the zipper slide of the present invention for restraining the tap portion from swinging include an elastic projection axially extended from the rear end of the tab portion and a hollow space formed at a top front of the slide for detachably receiving the elastic projection therein when the tab portion is in a flat position relative to the slide. When the tab portion is pivotally turned upward relative to the slide, the elastic projection is brought into contact with a front edge of the hollow space, and a further pull would deform the elastic projection to bring the same to move out of the hollow space for moving the slide forward or backward. And when the tab portion is pushed downward relative to the slide from a movable position, the elastic projection is deformed to slip into the hollow space again to restrain the pull tab from swinging relative to the slide.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 5:
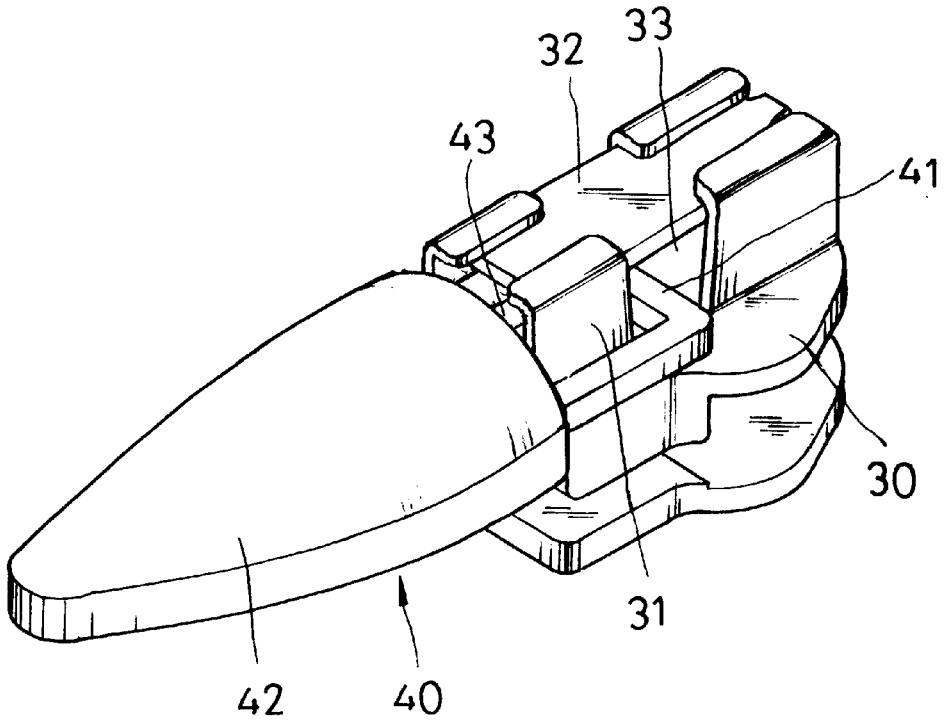
FIG. 5 is a perspective of a zipper slide according to a first embodiment of the present invention.
Figure 6:
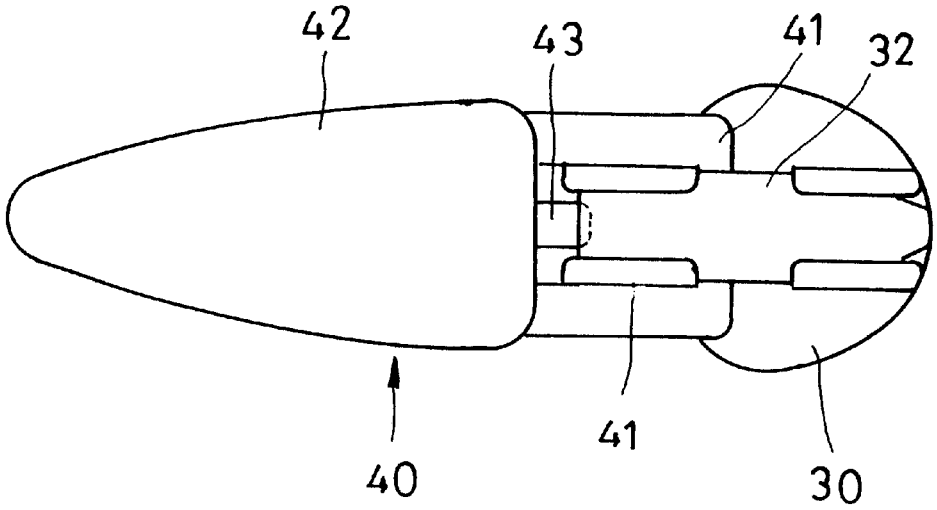
FIG. 6 is a top plan view of the zipper slide of FIG. 5.

Please refer to FIGS. 5 and 6 that are perspective and top plan views, respectively, of a zipper slide according to a first embodiment of the present invention. As shown, the zipper slide mainly includes a slide 30 and a pull tab 40 connected to a front end of the slide 30.

The pull tab 40 is composed of a substantially U-shaped buckle 41 and a plastic-coated tab portion 42 in front of the buckle 41, so that an opening is provided between the buckle 41 and the tab portion 42.

The slide 30 is formed on a top surface at, for example, for corners with spaced raised portions 31 (four are shown in the drawings). A top plate 32 is horizontally connected to upper ends of the raised portions 31 to provide a central passage 33 below the top plate 32 and across the top surface of the slide 30, such that the pull tab 40 may be connected to the slide 30 by extending a transverse head bar of the U-shaped buckle 41 through the central passage 33.

Figure 7:
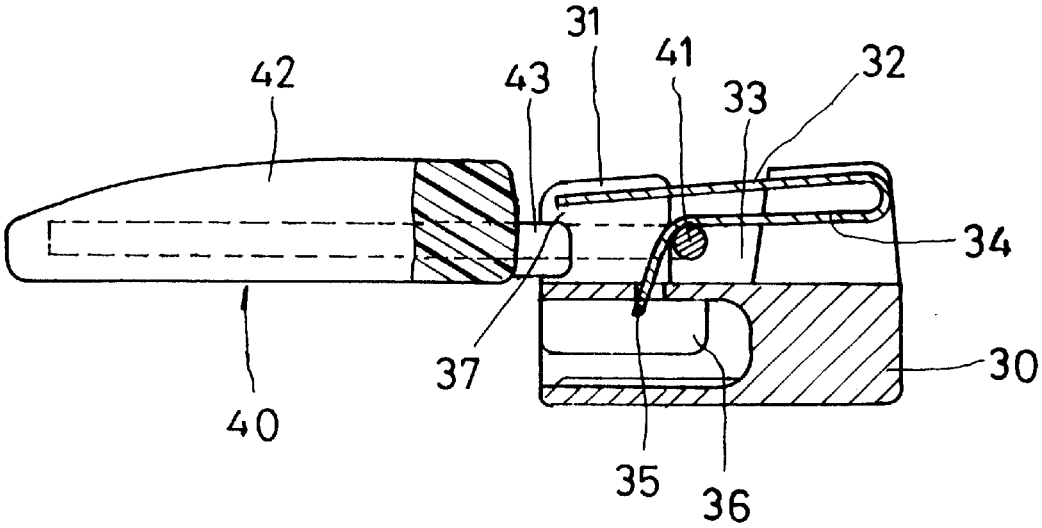
FIG. 7 is a sectional view of the zipper slide of FIG. 5 with a pull tab thereof lying in a flat and locked position.

Please now refer to FIG. 7 that is a sectional view of the zipper slide of FIG. 5. The top plate 32 is connected at a rear end with a leaf spring 34 that extends forward below the top plate 32. A front portion of the leaf spring 34 passes and abuts on the transverse head bar of the U-shaped buckle 41 of the pull tab 40 to apply a restraining pressure on the buckle 41. A free end 35 of the leaf spring 34 turns downward to pierce into a channel 36 of the slide 30 through which zipper teeth (not shown) pass.

Figure 8:
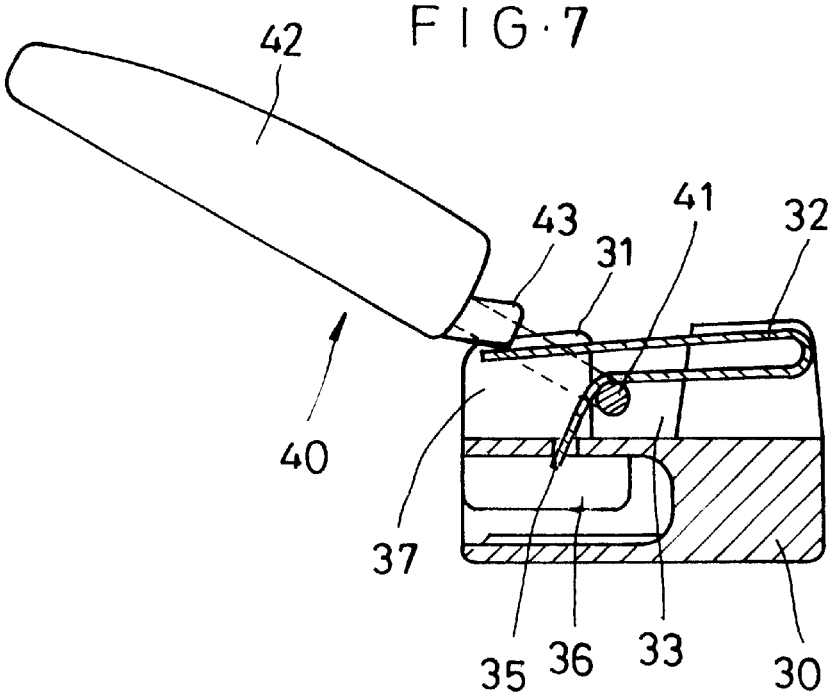
FIG. 8 illustrates the zipper slide of FIG. 5 with the pull tab thereof being pulled to a movable position.

The tab portion 42 of the pull tab 40 is provided at a rear end facing the U-shaped buckle 41 with an axially extended elastic projection 43. The projection 43 extends into a hollow space 37 formed on a top front of the slide 30 below the top plate 32. When the tab portion 42 of the pull tab 40 is pivotally turned upward relative to the slide 30, the elastic projection 43 is brought into contact with a front edge of the top plate 32. When the tab portion 42 is further pulled, the elastic projection 43 is deformed to pass the front edge of the top plate 32 to a movable position, as shown in FIG. 8. When the tab portion 42 is pushed downward to a flat position relative to the slide 30, the elastic projection 43 deforms again when it contacts with the front edge of the top plate 32. A further push causes the projection 43 to slips over the top plate 32 and extend into the hollow space 37 below the top plate 32 again to restrain the tab portion 42 and accordingly the whole pull tab 40 from swinging relative to the slide 30, as shown in FIG. 7.

Figure 1:
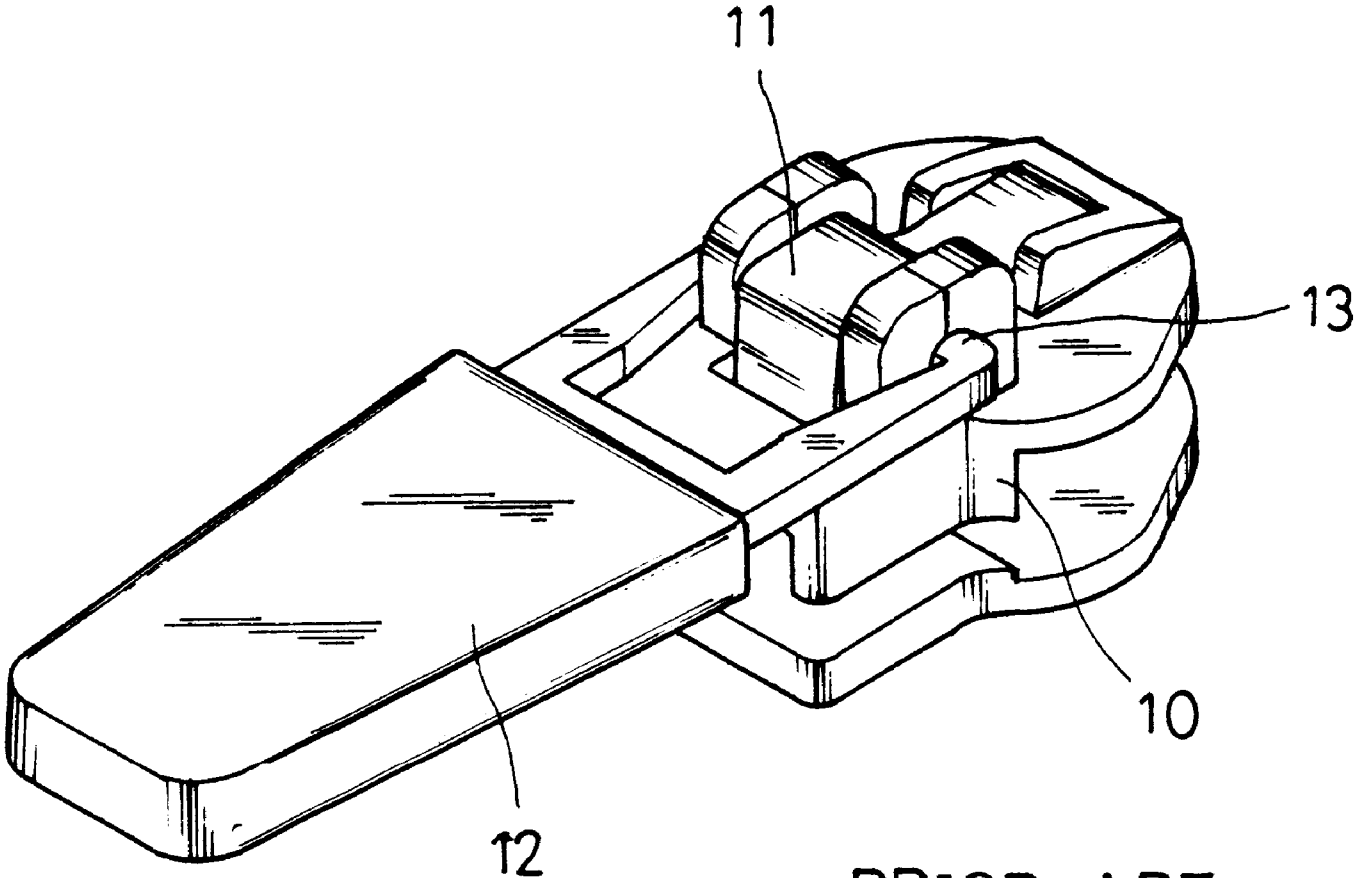
PRIOR ART FIG. 1
FIG. 1 is a perspective of a conventional zipper slide with means for restraining a pull tab thereof from swinging.
Figure 2:
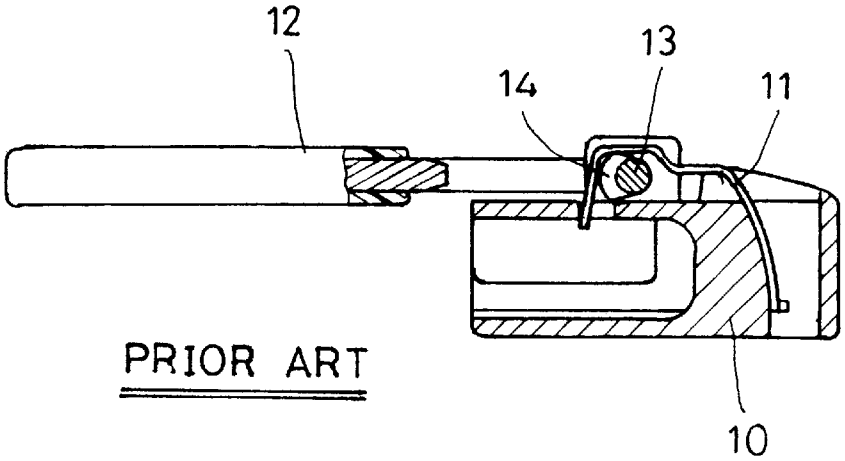
PRIOR ART FIG. 2
FIG. 2 is a sectional view of the zipper slide of FIG. 1.
Figure 3:
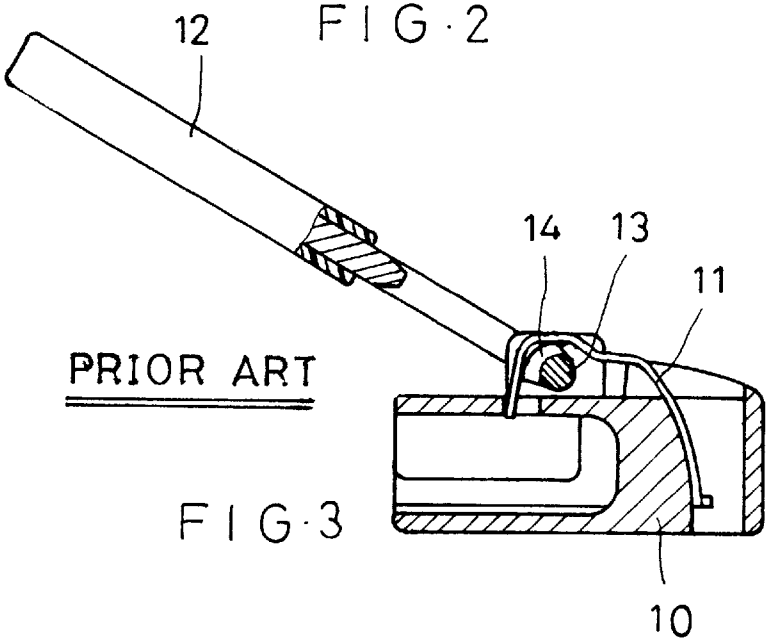
PRIOR ART FIG. 3
FIG. 3 illustrates the pull tab of the zipper slide of FIG. 1 being set to an angular position from where the pull tab automatically turns into a flat and locked position as shown in FIG. 3.
Figure 4:
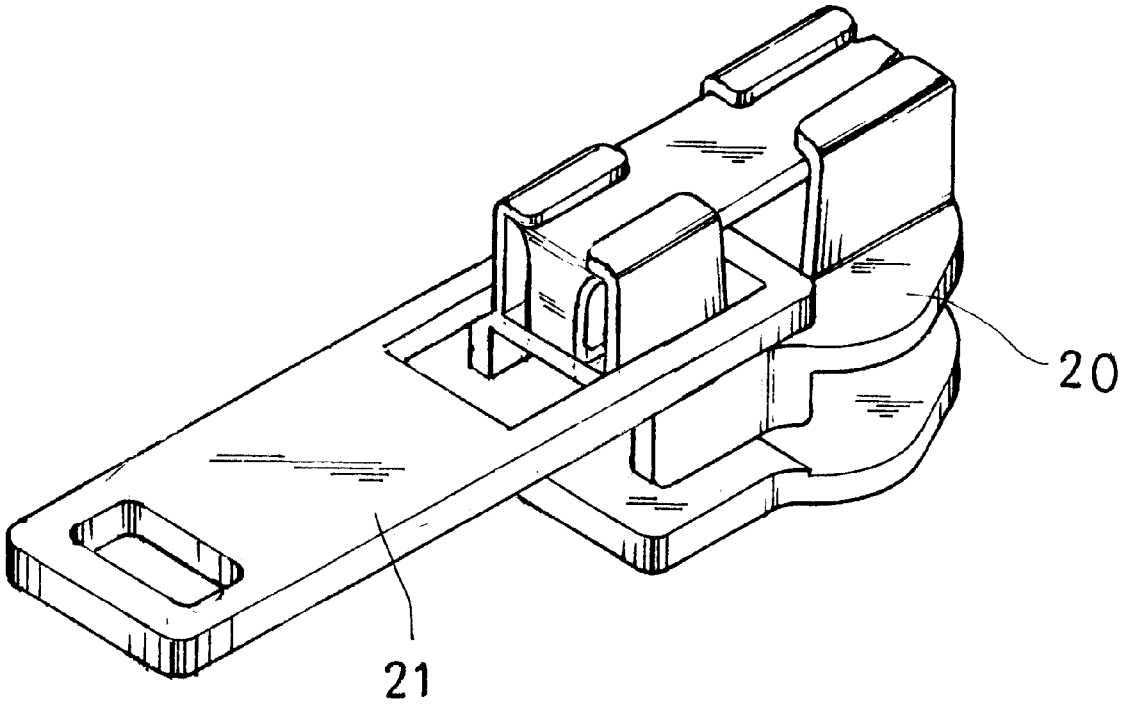
PRIOR ART FIG. 4
FIG. 4 is a perspective of a conventional zipper slide without means for restraining a pull tab thereof from swinging.

The slide 30 of the zipper slide of FIG. 5 has a structure generally similar to that of the conventional zipper slide of FIG. 4 that is not provided with means for restraining the pull tab from swinging, except the slide 30 is formed at the top front with the hollow space 37.

Figure 9:
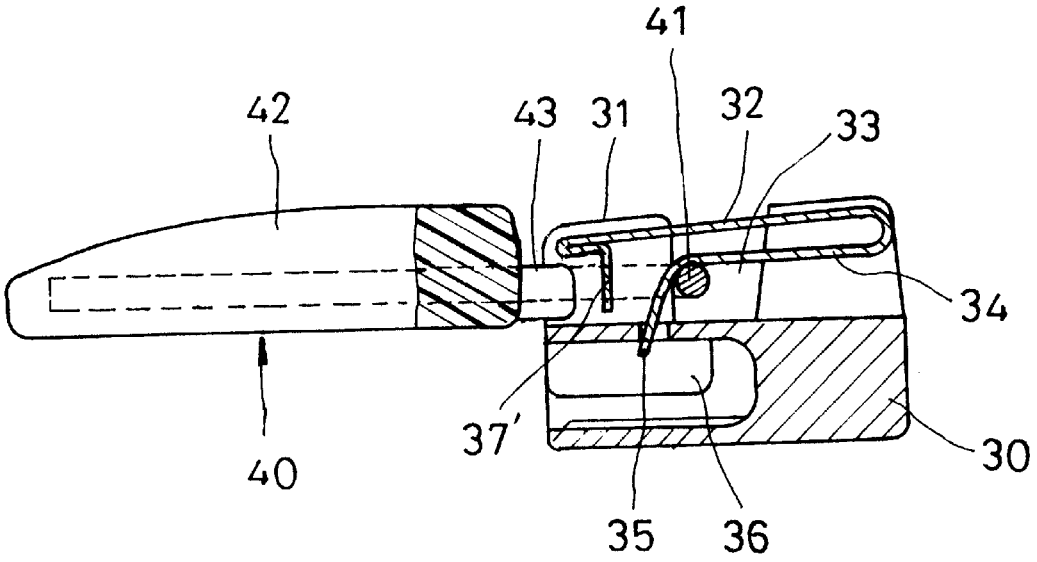
FIG. 9 is a sectional view of a zipper slide according to a second embodiment of the present invention.

In a second embodiment of the present invention as shown in FIG. 9, the hollow space 37 is replaced with a hollow recess 37'. This second embodiment is similar to the first embodiment, except a front end of the top plate 32 is suitably extended and bent to turn downward to provide a hollow recess 37' on the top front of the slide 30.

The pull tab 40 of the present invention is characterized in the elastic projection 43 backward extended from the tab portion 42. When the tab portion 42 is pivotally turned upward relative to the slide 30 to pull and move the latter, the elastic projection 43 in the hollow space 37 or the hollow recess 37' is brought to contact with and therefore stopped by the front edge of the top plate 32. At this point, a suitable pull further applied on the tab portion 42 would deform the projection 43 to allow the projection 43 to move out of the hollow space 37 or the hollow recess 37' and the pull tab 40 to enter into a pivotally movable position relative to the slide 30, as shown in FIG. 8. And when the tab portion 42 is pivotally pushed downward toward the slide 30, the projection 43 is deformed when it contacts with the front edge of the top plate 32. And a further push would bring the deformed projection 43 to slip over the front edge of the top plate 32 and enter into the hollow space 37 or the hollow recess 37', causing the pull tab 40 to lie flatly relative to the slide 30, as shown in FIGS. 7 and 9. When the pull tab 40 lies flatly with the projection 43 extended into the hollow space 37 or the hollow recess 37', the tab portion 42 of the pull tab 40 is restrained from swinging relative to the slide 30 even if the zipper slide of the present invention is in a vibrating state.

Following are some of the advantages of the zipper slide of the present invention:

1. Having Means for Restraining the Pull Tab from Swinging:

The zipper slide of the present invention is provided with means for locking the pull tab 40 in a flat position relative to the slide 30, so that the tab portion 42 thereof would not swing with movement of a wearer.

2. Low Manufacturing Cost:

The zipper slide of the present invention can be made through the same processes as those for making conventional zipper slides without tab-restraining means. The manufacturing cost of the present invention is therefore considerable low.

3. Automated Connection of Zipper Slide to Zipper Tapes is Possible:

The pull tab 40 would not automatically pivotally turn away from the slide 30 into a movable pulling position. This allows tools on an automatic zipper slide connecting machine (not shown) to hold the pull tab 40 for automated connection operation.

4. Baking Finish and Plating of Zipper Slide is Possible:

The elastic projection 43 on the pull tab 40 would not lose its elasticity due to baking finish and/or plating thereof. The zipper slide of the present invention can therefore be baking-finished or plated in an assembled state.

In brief, the zipper slide of the present invention has simple structure and can be manufactured at low cost, and is convenient for use.

What is claimed is:

1. A zipper slide comprising a pull tab, a slide connected to a rear end of said pull tab, and means for restraining said pull tab from swinging relative to said slide;

said pull tab being composed of a substantially U-shaped buckle and a plastic-coated tab portion in front of said buckle, so that an opening is provided between said U-shaped buckle and said tab portion;

said slide being formed at a top surface at predetermined positions with spaced raised portions, a top plate being horizontally connected to upper ends of said raised portions to provide a central passage across said top surface of said slide and below said top plate, such that said pull tab may be connected to said slide by extending said U-shaped buckle through said central passage; and said means for restraining said pull tab from swinging relative to said slide including an elastic projection axially extended from a rear end of said tab portion of said pull tab, and a hollow space or recess formed on a top front of said slide and below a front edge of said top plate suitable for detachably receiving said elastic projection therein when said pull tab is in a flat position relative to said slide;

whereby when said tab portion of said pull tab is pivotally turned upward relative to said slide from the flat position to a movable position, said elastic projection is brought into contact with the front edge of said top plate and deformed when it is forced to pass the front edge of said top plate with a further pull, and when said tab portion is pushed downward relative to said slide from the movable position to the flat position, said elastic projection deforms when it contacts with the front edge of the top plate and slip over the front edge of said top plate to extend into said hollow space or recess below said top plate when a further push is applied, causing said tab portion and accordingly said pull tab to be restrained from swinging relative to said slide.

2. The zipper slide as claimed in claim 1, wherein four spaced raised portions are formed at four top comers, respectively, of said top surface.

* * * * *